US008956564B2

(12) United States Patent
Kojo

(10) Patent No.: US 8,956,564 B2
(45) Date of Patent: Feb. 17, 2015

(54) SUPPLY SYSTEM FOR SUSPENSION SMELTING FURNACE

(75) Inventor: Ilkka Kojo, Kirkkonummi (FI)

(73) Assignee: Outotec Oyj, Espoo (FI)

( * ) Notice: Subject to any disclaimer, the term of this patent is extended or adjusted under 35 U.S.C. 154(b) by 1373 days.

(21) Appl. No.: 10/585,293

(22) PCT Filed: Jan. 10, 2005

(86) PCT No.: PCT/FI2005/000010

§ 371 (c)(1),
(2), (4) Date: Apr. 14, 2009

(87) PCT Pub. No.: WO2005/067366

PCT Pub. Date: Jul. 28, 2005

(65) Prior Publication Data

US 2009/0226284 A1 Sep. 10, 2009

(30) Foreign Application Priority Data

Jan. 15, 2004 (FI) ..... 20040046

(51) Int. Cl.
*C22B 5/12* (2006.01)
*C22B 15/00* (2006.01)
(Continued)

(52) U.S. Cl.
CPC ..... *C22B 15/0047* (2013.01); *F27B 1/20* (2013.01); *F27D 3/0025* (2013.01); *F27D 3/0033* (2013.01); *C22B 5/14* (2013.01)
USPC ..... 266/182; 414/161

(58) Field of Classification Search
CPC ..... C22B 5/14; C22B 15/0047; F27D 3/003; F27D 3/0025; F27B 1/20
USPC ..... 266/182, 187, 161, 189, 197; 75/454, 75/649, 629, 641, 643, 638, 639, 659; 414/161
See application file for complete search history.

(56) References Cited

U.S. PATENT DOCUMENTS 2,757,782 A * 8/1956 Davis ..... 198/575
3,471,283 A * 10/1969 Freeman ..... 75/454
(Continued)

FOREIGN PATENT DOCUMENTS

DE 3201608 9/1982
GB 617427 5/1946
(Continued)

OTHER PUBLICATIONS

Simon-Macawber Ltd., "Continuous High Accuracy Pneumatic Conveying," Brochure 1012, Jun. 20, 1994, pp. 1-4.
(Continued)

*Primary Examiner* — Scott Kastler
*Assistant Examiner* — Michael Aboagye
(74) *Attorney, Agent, or Firm* — Chernoff, Vilhauer, McClung & Stenzel LLP

(57) ABSTRACT

A supply system for providing a suspension smelting furnace with constant and continuous feed is disclosed. The installation of the invention comprises intermediate storage bins for fine-grained feed, a feed rate controller for accurately controlling the feed rate of the fine-grained material, and a pneumatic conveyor for lifting the feed up to the top level of the suspension smelting furnace where the burner of the furnace is adapted. In the installation, the heavy constructions of the storage bins are located close to the ground level and the constructions around and on top of the furnace have been designed essentially lighter than in conventional solutions.

1 Claim, 4 Drawing Sheets

(51) Int. Cl.

| | |
|---|---|
| ***F27B 1/20*** | (2006.01) |
| ***F27D 3/00*** | (2006.01) |
| *C22B 5/14* | (2006.01) |

(56) References Cited

U.S. PATENT DOCUMENTS

| | | | | | |
|---|---|---|---|---|---|
| 3,539,336 | A | * | 11/1970 | Urich | 75/762 |
| 3,666,248 | A | * | 5/1972 | Frundl et al. | 75/576 |
| 3,754,891 | A | * | 8/1973 | Bryk et al. | 75/630 |
| 3,796,568 | A | | 3/1974 | Szekely et al. | |
| 3,811,823 | A | * | 5/1974 | Warshawsky | 432/80 |
| 3,900,310 | A | | 8/1975 | Kaasila et al. | |
| 4,210,315 | A | * | 7/1980 | Lilja et al. | 266/182 |
| 4,490,170 | A | | 12/1984 | Lilja et al. | |
| 4,555,387 | A | | 11/1985 | Sabacky et al. | |
| 4,798,532 | A | | 1/1989 | Kimura et al. | |
| 4,844,915 | A | * | 7/1989 | Hooper | 423/235 |
| 5,445,363 | A | * | 8/1995 | Becerra-Novoa et al. | 266/182 |
| 5,772,955 | A | * | 6/1998 | Hanniala et al. | 266/182 |
| 6,001,148 | A | * | 12/1999 | Okamoto et al. | 75/10.15 |
| 6,238,457 | B1 | | 5/2001 | Holmi et al. | |
| 6,565,799 | B1 | | 5/2003 | Kojo et al. | |
| 2005/0199095 | A1 | * | 9/2005 | Hanniala et al. | 75/649 |
| 2006/0157899 | A1 | * | 7/2006 | Weaver | 266/197 |

FOREIGN PATENT DOCUMENTS

| | | | |
|---|---|---|---|
| GB | 617427 | * | 2/1949 |
| JP | 6212298 | | 8/1994 |
| WO | 0073519 | A1 | 12/2000 |

OTHER PUBLICATIONS

Wilkie, A.M., "Advanced Cement Kiln Coal Dust and Additive Feeding Technology," World Cement, Dec. 1995, pp. 1-4.

Simon-Macawber Ltd., "Roto Feed Suitable for a Wide Variety of Applications . . . , " Jun. 20, 1994.

Examiner's Report, dated Sep. 30, 2009 for Australian Patent Application No. 2005204467, by Outokumpu Technology Oy, 2 pgs.

Search Report, dated Oct. 21, 2011 for Chilean Patent Application No. 3339-04, by Outokumpu Technology Oy, 2 pgs.

First Office Action, including Text Portion of the First Office Action, dated Jun. 15, 2007 for Chinese Patent Application No. 200580002412.8, by Outokumpu Technology Oy, 3 pgs.

Search Report, dated Mar. 28, 2003 for Spanish Patent Application No. 200650048, by Outokumpu Technology Oy, 1 pg.

Final Office Action, dated May 17, 2010 for Japanese Patent Application No. 2006-548324, by Outokumpu Technology Oy, 3 pgs.

A.M. Wilkie, Clyde Pneumatic Conveying, "Advanced cement kiln coal dust and additive feeding technology," World Cement, Dec. 1995, 4 pgs.

* cited by examiner

SUPPLY SYSTEM FOR SUSPENSION SMELTING FURNACE

This is a national stage application filed under 35 USC 371 based on International Application No. PCT/FI2005/000010 filed Jan. 10, 2005, and claims priority under 35 USC 119 of Finnish Patent Application No. 20040046 filed Jan. 15, 2004.

This invention relates to a supply system for supplying a suspension smelting furnace with a feed of fine-grained material. Particularly, the invention relates to a method and an installation of feeding metal concentrate containing fine-grained material in a burner of a suspension smelting furnace.

Suspension smelting is a method of producing matte or metal from finely divided metal concentrates, such as copper, nickel or lead concentrates. Typically, a suspension smelting furnace comprises a round vertical reaction shaft for roasting and smelting dried concentrate in suspension; a settling hearth for collecting the molten droplets and separating matte or metal from slag; and an uptake shaft for waste gas and flue dust.

The smelting of the metal concentrate mainly takes place in the vertical reaction shaft. The metal concentrate, oxygen enriched air, and slag-forming agent, i.e. flux, is fed into the reaction shaft via the top part of the shaft.

Various sorts of concentrates and fluxes are mixed and dried in a rotary dryer, a steam dryer or a flash dryer. The dried feed is conveyed to the top of the reaction shaft, where the concentrate burner is mounted. Several different types of concentrate burners have been developed to advantageously realize the reactions between the solids and gas in the reaction shaft.

Suspension smelting is a high-capacity method of refining metal concentrates. Production capacity of a modern suspension smelting furnace can be characterized by daily concentrate throughput which is in the range of several thousands (2000-5000) of tons of dried concentrate. In running a modern suspension smelting furnace, it is essential that the utilization rate is kept high. The target is to continuously maintain full operation of the furnace for hundreds of hours. Unnecessary down time can be reduced by ensuring a continuous and reliable operation of the concentrate feeding system for the burner of the smelting furnace.

Known approach to solve the problem of providing a continuous and reliable feed of concentrate into the burner is to construct an intermediate storage bin for the concentrate close to the burner on the level of the top of the reaction shaft. Constant feed rate is realized with a feeding control unit arranged between the intermediate storage bin and the burner. Dried concentrate may be lifted with a pneumatic conveyor into the intermediate storage bin. The charge of the intermediate storage bin should approximately correspond to a three- or four-hours feed of the suspension furnace, i.e. 100-600 tons of concentrate. As the height of the furnace exceeds 20 meters, the construction of the intermediate storage bin becomes heavy and requires high investment.

The present invention solves the problem described above and provides an improved method and installation for providing a burner of a suspension smelting furnace with reliable and continuous concentrate feed. The invention is based on the idea that the heavy construction of the intermediate storage bin, or concentrate bin, is located below the level of the top of the reaction shaft, i.e. close to the ground level. More particularly, the outlet of the concentrate bin is located below the level of the top of the reaction shaft and close to the ground level.

The feed of the burner is fine-grained matter and comprises dried mixture of concentrate and flux and most often also flue dust. In a suspension smelter, it is common practice to recycle flue dust recovered from the exhaust gas. The feed is conveyed on the top level of the reaction shaft with a pneumatic conveyor. The feed rate is controlled with a feed rate controller that is connected between the intermediate storage bin and the pneumatic conveyor.

Remarkable advantages are reached by aid of the present invention. The installation for feeding concentrate mixture into a suspension smelting furnace is simple and the construction becomes lighter. Further, the installation and the method of the present invention requires lower investments than the constructions presently in use. The installation and the method eliminate incident interruptions of the feed from a concentrate dryer.

The installation of the present invention provides a concentrate burner of a suspension smelting furnace with continuous and constant feed of fine-grained matter. The concentrate burner is located on top of a reaction shaft of a suspension smelting furnace. The installation of the present invention comprises an intermediate storage bin having an inlet and outlet for the fine-grained matter; a fee control unit for providing the feed of the particulate matter with accurately controlled feed rate; and a pneumatic conveyor adapted to transport the particulate matter up to the top level of the suspension smelting furnace. The outlet of the bin for the fine-grained matter is located essentially at a lower level than the top of the reaction shaft. The feed control unit is receives fine-grained matter from the outlet of the bin and provides the pneumatic conveyor with the feed of the particulate matter. The pneumatic conveyor provides the concentrate burner with a feed rate that equals the feed rate provided by the feed control unit.

The method of the present invention provides a concentrate burner that is located on top of a reaction shaft of a suspension smelting furnace with an uninterrupted and controlled feed of fine-grained matter comprising metal concentrate. The method comprises steps of feeding fine-grained matter in an intermediate storage bin having an outlet at a lower level than the burner; forming and sustaining in the bin a storage of the fine-grained matter corresponding with at least one hours feed of the suspension smelting furnace; feeding fine-grained matter in a feed rate controller unit that provides the pneumatic conveyor with an uninterrupted and controlled feed of the fine-grained matter; and conveying the matter with the pneumatic conveyor to the burner of the suspension smelting furnace.

The fine-grained matter to be fed into the concentrate burner is a mixture of dried metal concentrate and flux. Further, the feed mixture of a suspension furnace may comprise 3-15% of flue dust recovered from the outlet gas after the uptake shaft of the suspension furnace.

According to a preferred embodiment of the present invention the outlet of the intermediate storage bin is connected to a loss-in-weight —type feed controller. The operation and principles of a loss-in-weight feeder is described in U.S. Pat. No. 6,446,836. The feed controller feeds the concentrate into a dilute-phase pneumatic conveyor. The density of the transported fine-grained matter is 10-50 kg solid material/1 kg air and the conveying pressure is normally between 1 and 3 bar. The pneumatic conveyor lifts the particulate matter on top of the reaction shaft and the pneumatic conveyor feeds the material straight into the concentrate burner. The feed rate into the concentrate burner equals with the feed rate provided by the feed controller.

According to another preferred embodiment of the present invention the outlet of the intermediate storagebin bin is connected to a feed controller of a dense-phase pneumatic conveyor. The pressure in the pneumatic conveyor and in the feed controller unit of the conveyor is around 6 bar. The density of the transported fine-grained matter is 50-150 kg solid material/1 kg air. The pneumatic conveyor feeds fine-grained matter straight into the concentrate burner.

According to one more embodiment of the present invention the outlet of the intermediate storage bin is connected to a loss-in-weight-type feed controller. The feed controller feeds the concentrate into an air-lift-type pneumatic conveyor. The pressure in the air-lift is around 0.3 bar. The air-lift conveyor is provided with an expansion vessel where most of the compressed air is separated from the solid. The solid is fed via an air-lock feeder in to an air-slide-type conveyor, which feeds the concentrate into the concentrate burner. The mass flow provided by the air-slide conveyor is equal to the feed rate provided by the loss-in-weight controller.

Figure 1:
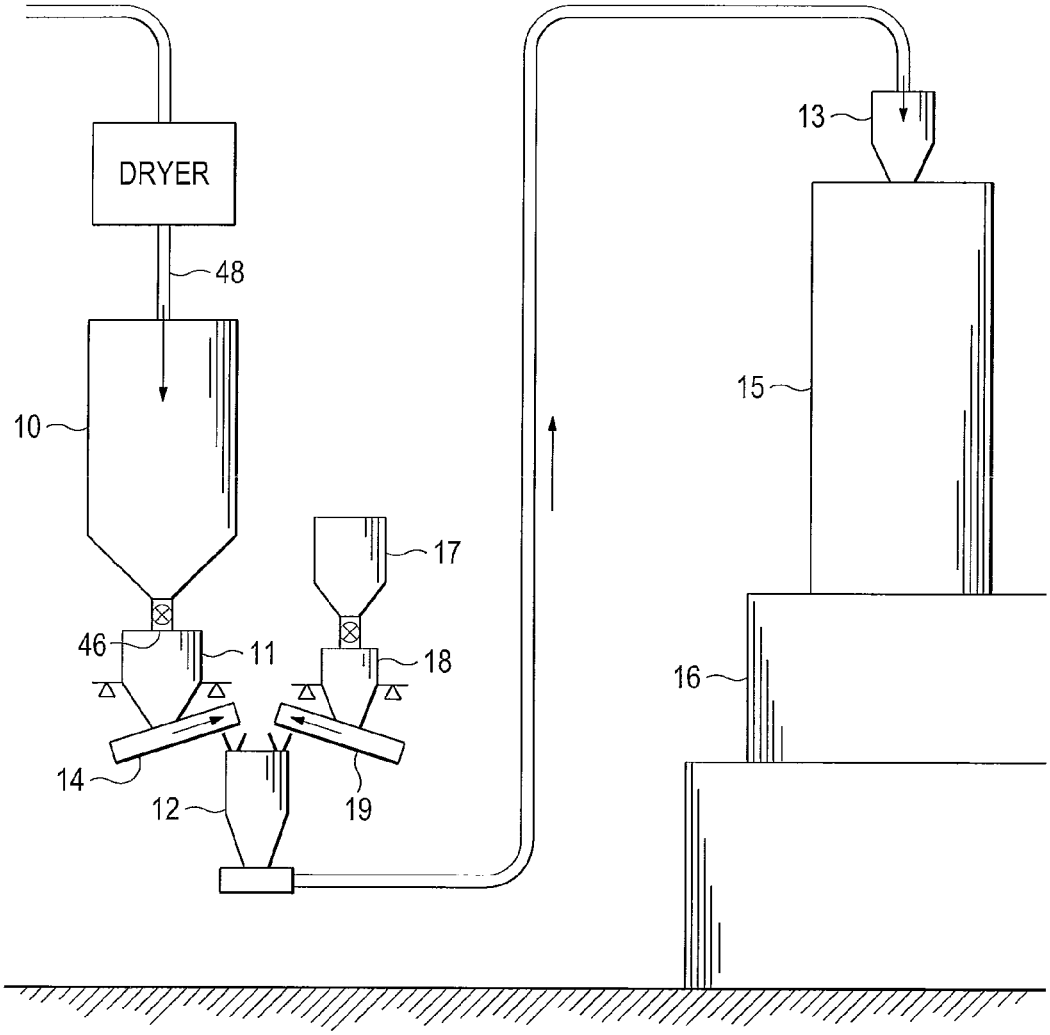
FIG. 1 is a schematic presentation of an installation of a preferred embodiment of the present invention.

In the installation of FIG. 1, dried mixture of metal concentrate and fluxing agent is fed via pipe 48 into an intermediate storage bin 10. The outlet 46 of the bin is adapted to feed the concentrate mixture into a loss-in-weight feed controller 11. A screw conveyor 14 conveys an accurate mass flow of the concentrate mixture into a pneumatic conveyor 12, which is a dilute-phase pneumatic conveyor. The pneumatic conveyor 12 lifts the concentrate mixture up to the concentrate burner 13 of the suspension smelting furnace 16. As shown in FIG. 1, the outlet 46 of the bin 10 is located at essentially lower level than the top of the reaction shaft 15 and the concentrate burner 13. Flue dust is fed into a bin 17. The feed ratio of the concentrate mixture and the flue dust has to be carefully controlled. Therefore, the flue dust is fed into a feed rate controller 18 and the controlled mass flow of the flue dust is conveyed via a screw conveyor 19 into the pneumatic conveyor 12. The flow of the concentrate mixture and the flue dust is continuous and thus ensures uninterrupted operation of the suspension smelting furnace 16.

Figure 1A:
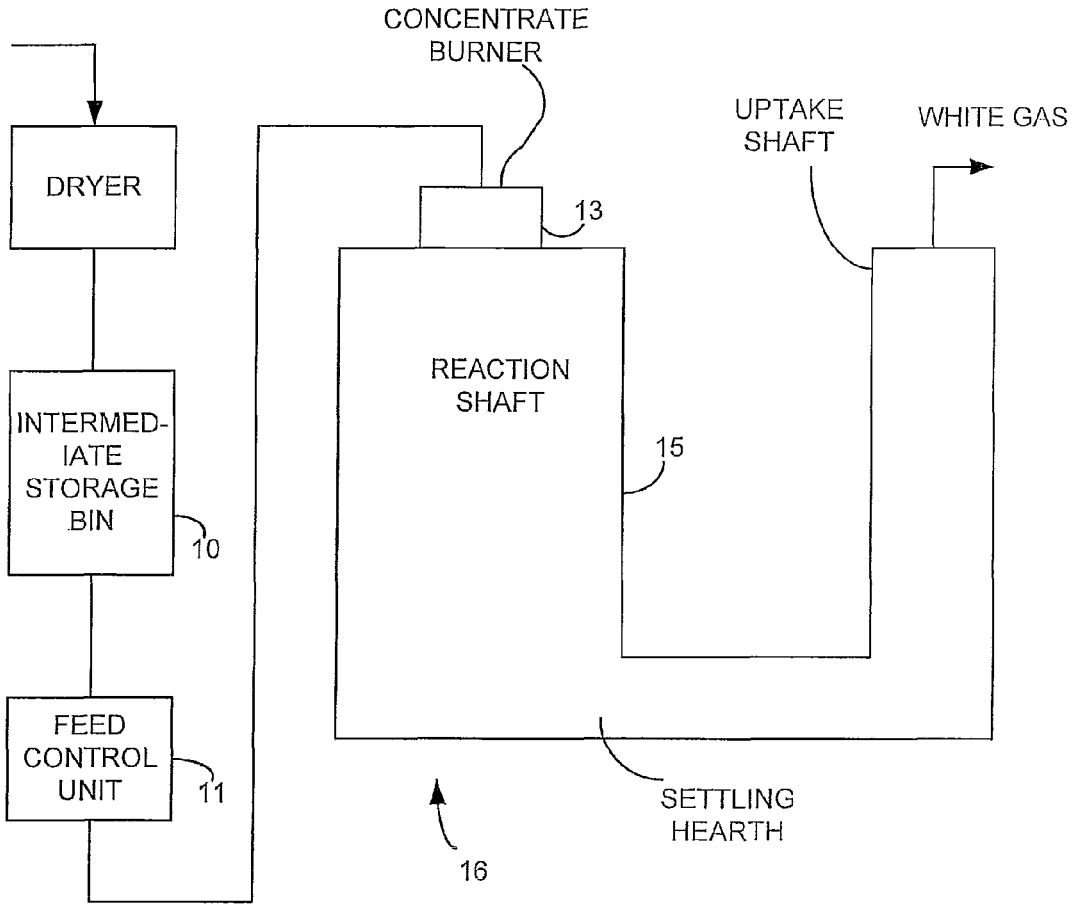
FIG. 1A is a schematic presentation illustrating the supply system shown in FIG. 1 and illustrating more fully the suspension smelting furnace.

FIG 1A shows not only the vertical reaction shaft 15 of the suspension smelting furnace 16 but also the settling hearth for collecting the molten droplets and separating matte or metal from slag, and the uptake shaft for waste gas and flue dust.

Figure 2:
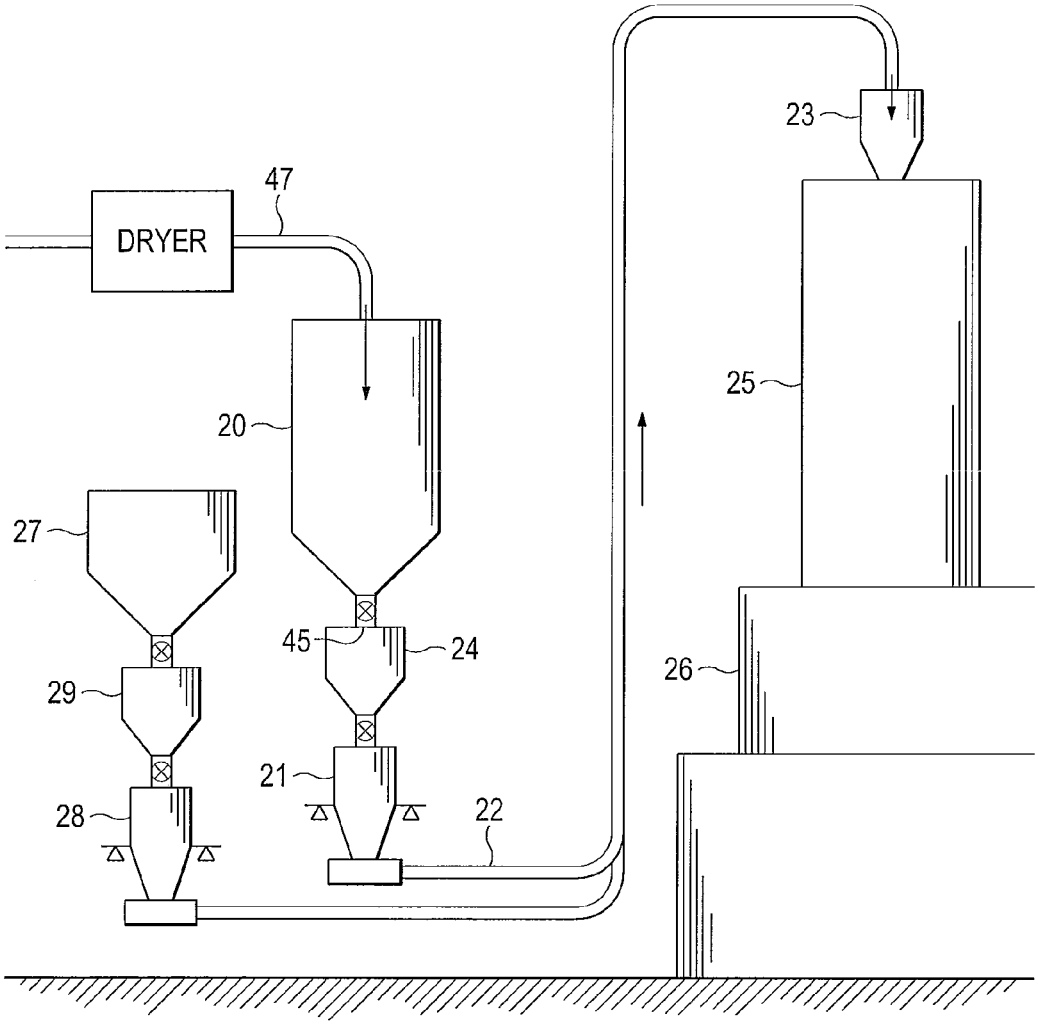
FIG. 2 is a schematic presentation of an installation of another preferred embodiment of the present invention.

FIG. 2 shows that dried mixture of metal concentrate and fluxing agent is fed via pipe 47 into an intermediate storage bin 20. The outlet 45 of the bin is connected to feed the concentrate mixture into an intermediate pressure chamber 24 for loading the feed controller 21 of the pneumatic conveyor 22. The pneumatic conveyor 22 is a dense-phase pneumatic conveyor. An accurate mass flow of the concentrate mixture is fed into the pneumatic conveyor 22. The pneumatic conveyor 22 lifts the concentrate mixture up to the concentrate burner 23 of the suspension smelting furnace 26. As shown in FIG. 2, the outlet 45 of the bin 20 is located at essentially lower level than the top of the reaction shaft 25 and the concentrate burner 23. Flue dust is fed into a bin 27. The feed ratio of the concentrate mixture and the flue dust is again carefully controlled. Therefore, the flue dust is fed via a loading chamber 29 into a feed rate controller 28 of a pneumatic conveyor 22 and the controlled mass flow of the flue dust is conveyed with the pneumatic conveyor up to the concentrate burner 23. The flow of the concentrate mixture and the flue dust is continuous and thus ensures uninterrupted operation of the suspension smelting furnace 26.

Figure 3:
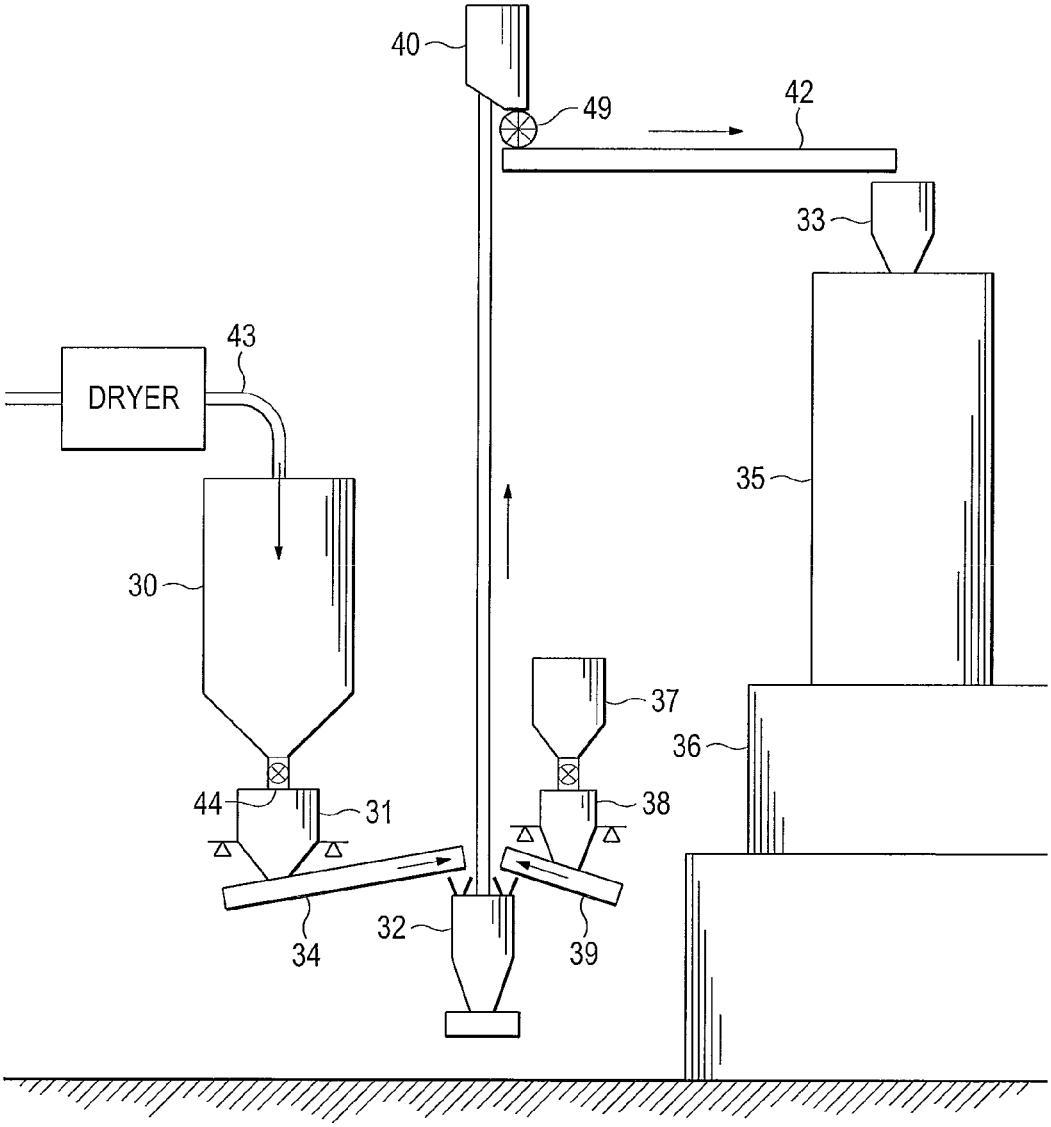
FIG. 3 is a schematic presentation of an installation of one more embodiment of the present invention.

FIG. 3 shows that dried mixture of metal concentrate and fluxing agent is fed via pipe 43 into an intermediate storage bin 30. The outlet 44 of the bin is adapted to feed the concentrate mixture into a loss-in-weight feed controller 31 for loading of the pneumatic conveyor 32. The pneumatic conveyor 32 is an air-lift type conveyor. An accurate mass flow of the concentrate mixture is fed into the pneumatic conveyor 32 via a screw conveyor 34. The pneumatic conveyor 32 lifts the concentrate mixture up to an expansion vessel 40 where the particulate matter is fed via an air-lock feeder on an air-slide conveyor 42. The concentrate burner 33 of the suspension smelting furnace 36 is provided with accurately controlled and continuous feed. As shown in FIG. 3, the outlet 44 of the bin 30 is located at essentially lower level than the top of the reaction shaft 35 and the concentrate burner 33. Flue dust is fed into a bin 37. The feed ratio of the concentrate mixture and the flue dust is again carefully controlled with the feed rate controllers 31 and 38. Therefore, the flow of the flue dust is controlled with a loss-in-weight controller 38 and fed via a screw conveyor 39 into the air-lift-type conveyor 32. The flow of the concentrate mixture and the flue dust is continuous and thus ensures uninterrupted breakable operation of the suspension smelting furnace 36.

The concentrate burners 13, 23, 33 may be of any type of metal concentrate burners. The concentrate burners especially suitable in the installation of the present invention are sleeve type burners and diffuser type burners. The principle of a sleeve type burner is disclosed in U.S. Pat. No. 6,238,457, and the principle of a diffuser type burner is disclosed in WO 02/055746.

The invention claimed is:

1. A suspension smelting furnace installation comprising:

a suspension smelting furnace defining a vertical reaction shaft for roasting and smelting dried concentrates in suspension, the reaction shaft having a top level, a concentrate burner mounted on top of the reaction shaft, a concentrate dryer for supplying dry fine-grained material, an intermediate storage bin having an inlet for receiving a supply of dry fine-grained material from the concentrate dryer and also having an outlet below the top level of the reaction shaft, a feed control unit for receiving the dry fine-grained material directly from the outlet of the bin and providing the dry fine-grained material with accurately controlled feed rate, and a pneumatic conveyor positioned to receive the dry fine-grained material from the feed control unit and adapted to transport the dry fine-grained material to the concentrate burner with a feed rate that equals the feed rate at which the fine-grained material is provided by the feed control unit;

wherein said intermediate bin is a first bin for receiving a dried mixture of metal concentrate and fluxing agent, the feed control unit for receiving the dry fine-grained material from the outlet of the bin is a first loss-in-weight controller, the installation further comprises a first screw conveyor for receiving the dry fine-grained material from the first loss-in-weight controller, a second bin for receiving flue dust, a second loss-in-weight controller for receiving the flue dust from the second bin and providing the flue dust with accurately controlled feed rate, and a second screw conveyor for receiving the flue dust from the second loss-in-weight controller, and the pneumatic conveyor is positioned to receive both the dried mixture of metal concentrate and fluxing agent from the first screw conveyor and the flue dust from the second screw conveyor.

* * * * *